United States Patent [19]

Matsuura

[11] Patent Number: 4,523,550

[45] Date of Patent: Jun. 18, 1985

[54] VALVE DISABLING DEVICE FOR INTERNAL COMBUSTION ENGINES

[75] Inventors: Shochi Honda, Tokyo; Yoshikatsu Nakano, Kawagoe; Hirano Makoto, Asaka; Masaaki Matsuura, Tokyo; all of Japan

[73] Assignee: Honda Giken Kogyo Kabushiki Kaisha, Tokyo, Japan

[21] Appl. No.: 652,816

[22] Filed: Sep. 20, 1984

[30] Foreign Application Priority Data

Sep. 22, 1983 [JP] Japan ..... 58-174262
Sep. 22, 1983 [JP] Japan ..... 58-174263

[51] Int. Cl.[3] ..... F01L 1/34

[52] U.S. Cl. ..... 123/90.16; 123/90.12; 123/90.17; 123/90.27; 123/308; 123/432

[58] Field of Search ..... 123/90.12, 90.15, 90.16, 123/90.17, 90.27, 308, 432, 198 F

[56] References Cited

U.S. PATENT DOCUMENTS

| | | | |
|---|---|---|---|
| 4,182,289 | 1/1980 | Nakajima et al. | 123/90.16 |
| 4,188,225 | 2/1980 | Jordan | 123/90.12 |
| 4,216,748 | 8/1980 | Ichida | 123/432 |
| 4,253,434 | 3/1981 | Takizawa et al. | 123/90.15 |
| 4,285,310 | 8/1981 | Takizawa et al. | 123/308 |
| 4,354,460 | 10/1982 | Mae et al. | 123/90.16 |
| 4,438,743 | 3/1984 | Namba et al. | 123/308 |
| 4,480,617 | 11/1984 | Nakano et al. | 123/432 |

FOREIGN PATENT DOCUMENTS

| | | | |
|---|---|---|---|
| 83631 | 5/1982 | Japan | 123/308 |

*Primary Examiner*—Ira S. Lazarus
*Attorney, Agent, or Firm*—Arthur L. Lessler

[57] ABSTRACT

A valve disabling device has an engaging member and an urging member slidably disposed, respectively, in first and second axial bores formed within, respectively, first and second rocker arm means, one of which engages a valve actuating cam. The engaging member is displaceable within the first axial bore by means of pressure applying means, into the second axial bore for driving coupling of the first and second rocker arm means whereby a pair of inlet valves or exhaust valves corresponding to the first and second rocker arm means make valving motions in unison with each other, or out of the second axial bore for disconnection of the first and second rocker arm means from each other to disable part of the valves. Biasing means biases the engaging member into the second axial bore irrespective of operation of the pressure applying means, to correspondingly bias the urging member into a predetermined position where a portion thereof is projected out of the second axial bore. Retaining means holds the urging member in the predetermined position, thus drivingly coupling the two rocker arm means.

11 Claims, 12 Drawing Figures

VALVE DISABLING DEVICE FOR INTERNAL COMBUSTION ENGINES

BACKGROUND OF THE INVENTION

This invention relates to a valve disabling device for internal combustion engines mainly adapted for use in motorcycles and other vehicles.

Conventional high output type internal combustion engines include a type which is equipped with a plurality of inlet valves and/or exhaust valves at each of the cylinders and thus adapted to permit large quantities of a mixture and/or exhaust gases to be supplied into and/or emitted from the engine cylinders. Also known in a valve disabling device for use with such high output type internal combustion engines, which is adapted to selectively hold the inlet valves and/or the exhaust valves in a first position wherein all the valves are rendered operative, and in a second position wherein part of the valves are rendered inoperative or disabled, to improve the output characteristic of the engine particularly in a low speed region.

A conventional valve disabling device of this kind includes first and second rocker arms provided for a pair of inlet valves and/or exhaust valves, one of which is engaged with a cam forming part of the valve actuating mechanism, a piston disposed within a cylinder bore formed in the first rocker arm, in a manner projectable toward and retractable away from the second rocker arm, and a guide pin disposed within a guide bore formed in the second rocker arm and permanently urged toward the first rocker arm. With this valve disabling device, when operating oil is supplied under high pressure to the cylinder bore from the hydraulic circuit connected thereto, the piston is forced into the guide bore by the operating oil against the urging force of the guide pin, thereby drivingly coupling the first and second rocker arms together. Then, as the cam engaging one of the two rocker arms rotates, the paired inlet valves and/or exhaust valves are actuated through the coupled rocker arms to make opening and closing actions in unison. On the other hand, when the high pressure operating oil is discharged from the cylinder bore, the piston is forced out of the guide bore by the urging force of the guide pin, to disconnect the two rocker arms from each other. Then, only one of the paired inlet valves and/or the exhaust valves, which corresponds to the rocker arm engaging the cam, is actuated to make opening and closing actions, while the other one of the valves is rendered inoperative or disabled. However, all the time during stoppage of the engine, an oil pump, which is driven by the engine to supply high pressure operating oil into the cylinder bore, is kept inoperative to hold the piston out of the guide bore by the urging force of the guide pin, thus holding the other one of the rocker arms not engaging the cam in a state disconnected from the same cam.

Further, in these engines equipped with a plurality of inlet valves and/or exhaust valves, each pair of the valves need to be opened and closed in synchronism with each other. To this end, in an engine equipped with the above-mentioned valve disabling device, it is necessary to subject the rocker arms which correspond to the paired valves to tappet adjustment, i.e. adjustment of the clearance between the cam and the rocker arms, with the rocker arms coupled together. However, the conventional valve disabling device is not provided with means for effecting such adjustment, making it difficult to perform with accuracy tappet adjustment of the rocker arm not engaging the cam during stoppage of the engine.

SUMMARY OF THE INVENTION

It is an object of the invention to provide a valve disabling device for internal combustion engines, which is capable of maintaining with ease the rocker arm engaging the cam and one not engaging the cam coupled together, without the use of operating oil pressure.

It is another object of the invention to provide a valve disabling device having the function mentioned in the preceding object, which can easily be converted from an existing valve disabling device.

It is a further object of the invention to provide a valve disabling device which can be easily operated to couple the rocker arms together, even when installed in a small space.

The present invention provides a valve disabling device for use in a valve actuating mechanism of an internal combustion engine, wherein the valve actuating mechanism has cam means, and first and second rocker arm means, one of which engages the cam means.

An engaging member and an urging member are slidably disposed, respectively, in first and second axial bores formed in the first and second rocker arm means. Pressure applying means is adapted to hydraulically force the engaging member into the second axial bore against the urging force of the urging member, whereby the first and second rocker arm means are drivingly coupled together to cause a pair of inlet valves or exhaust valves to make valving motions in unison with each other, while when the pressure applying means is inoperative, the engaging means is receded from the second axial bore through the urging member to thereby disconnect the first and second rocker arm means from each other to render part of the valves disabled.

Biasing means is adapted to bias the engaging member into the second axial bore irrespective of whether the pressure applying means is operative or inoperative. When the engaging member is biased by the biasing means, the urging member is adapted to assume a predetermined position where a portion thereof is projected out of the second axial bore for access from outside. The urging member is retained in the predetermined position by means of retaining means with the first and second rocker arm means coupled together.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
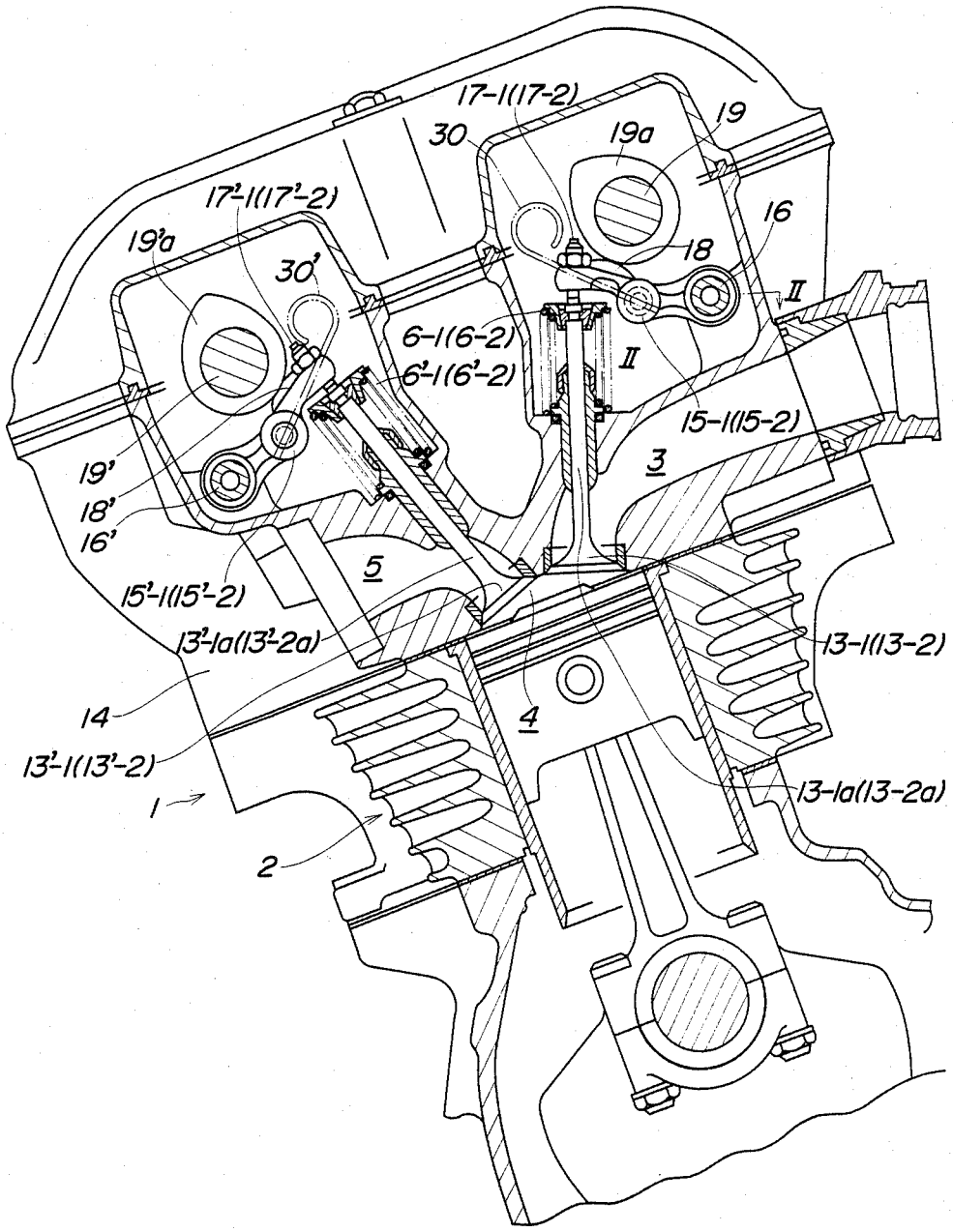
FIG. 1 is a fragmentary longitudinal sectional view of an internal combustion engine equipped with a valve disabling device according to a first embodiment of the invention.

Referring first to FIGS. 1 through 4, there is shown a valve disabling device for an internal combustion engine, according to a first embodiment of the invention. The internal combustion engine 1 has a plurality of cylinders 2, only one of which is shown in FIG. 1, each equipped with a pair of inlet valves 13-1 and 13-2 (only one of them is shown) for establishing and interrupting the communication between an intake passage 3 and a combustion chamber 4, and a pair of exhaust valves 13'-1 and 13'-2 (only one of them is shown) for establishing and interrupting the communication between an exhaust passage 5 and the combustion chamber 4. First and second rocker arms 15-1 and 15-2 for actuating the respective inlet valves 13-1, 13-2 are pivotally journalled by a common inlet rocker arm shaft 16 fixed to a cylinder head 14, while first and second rocker arms 15'-1 and 15'-2 for actuating the respective exhaust valves 13'-1, 13'-2 are pivotally journalled by a common exhaust rocker arm shaft 16' also fixed to the cylinder head 14. Ends of the rocker arms 15-1 to 15'-2 remote from the associated rocker arm shaft 16, 16' are each formed with a tapped bore, not shown, in which a tappet adjusting screw 17-1 to 17'-2 is threadedly fitted for axial displacement therein. The screws 17-1 to 17'-2 have their inner or lower ends abut against outer or upper ends of valve stems 13-1*a* to 13'-2*a* of the respective valves 13-1 to 13'-2. The first inlet rocker arm 15-1 and the first exhaust rocker arm 15'-1 are each formed integrally with a cam slipper 18, 18' at its upper surface at an end portion remote from a corresponding one of the rocker arm shafts 16, 16', and are disposed in urging contact with a corresponding cam 19*a*, 19'*a* formed integrally with a camshaft 19, 19' at its outer periphery, through the cam slipper 18, 18'. In FIG. 1, reference numerals 6-1 to 6'-2 designate valve springs urging the respective inlet and exhaust valves 13-1 to 13'-2 in the directions of closing them.

As clearly shown in FIG. 1, the valve actuating mechanisms for the inlet valves 13-1, 13-2 and the exhaust valves 13'-1, 13'-2 have substantially the same structure, and accordingly valve disabling devices for these valves are substantially identical in structure with each other. Therefore, description given below is only directed to the inlet valve disabling device.

Figure 2:
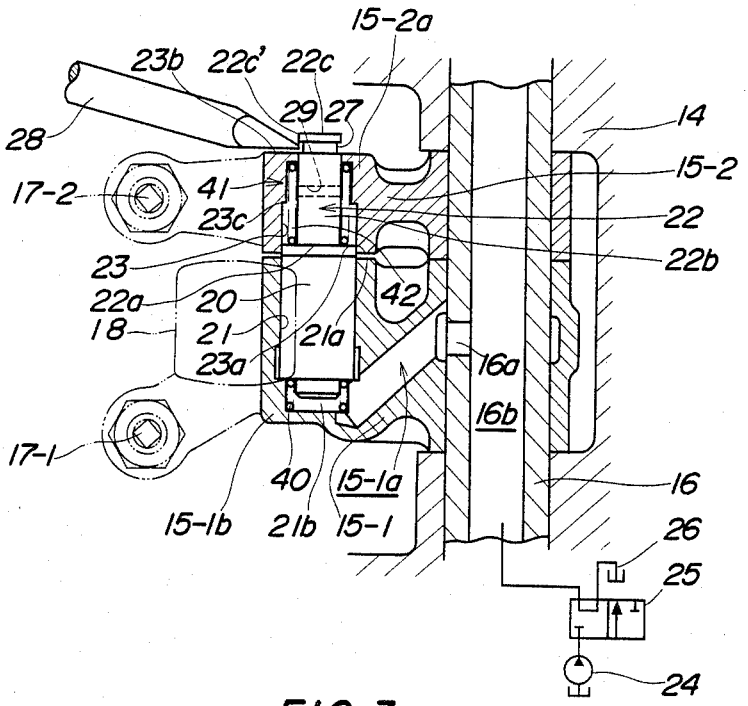
FIG. 2 is a fragmentary sectional view taken along line II—II in FIG. 1, showing rocker arms in a disconnected state, and their peripheral parts.
Figure 3:
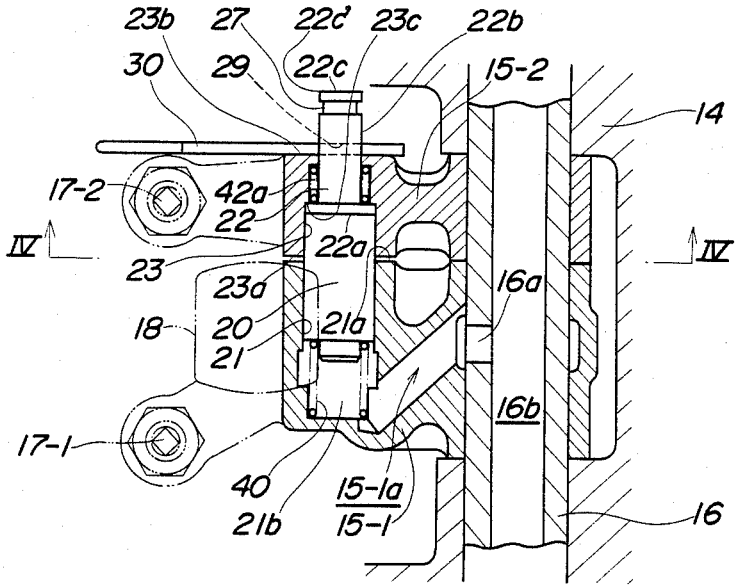
FIG. 3 is a view similar to FIG. 2, showing the rocker arms in a connected state.
Figure 4:
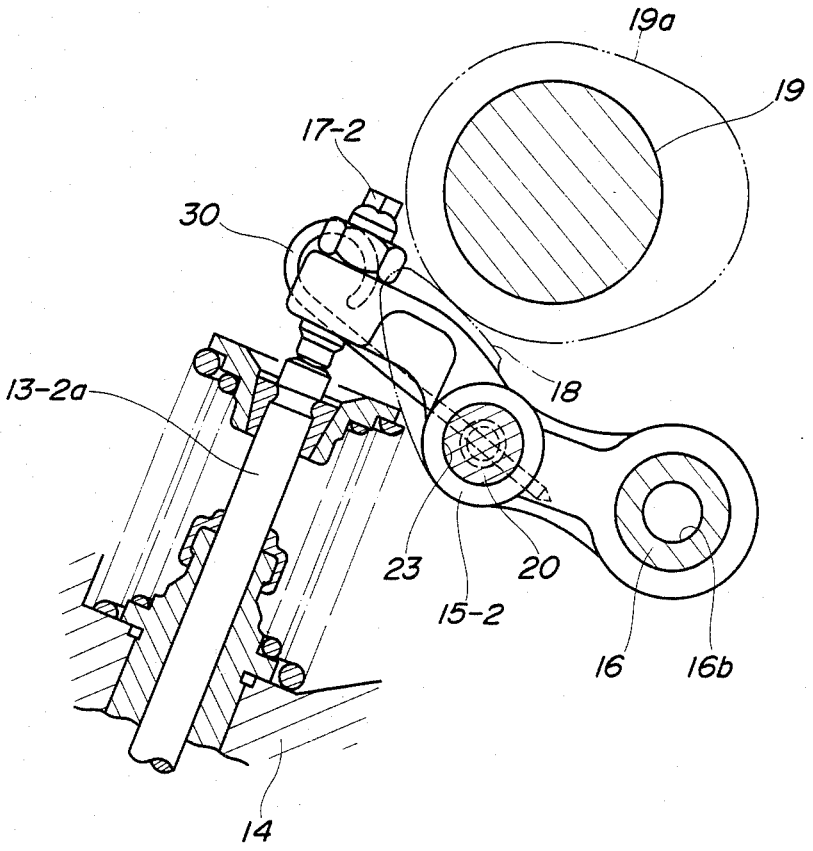
FIG. 4 is a fragmentary sectional view taken along line IV—IV in FIG. 3.

As shown in FIGS. 2 and 3, the first inlet rocker arm 15-1 is formed therein with a first axial bore or cylinder bore 21, and the second inlet rocker arm 15-2 with a second axial bore or stepped guide bore 23 axially aligned with the cylinder bore 21, respectively. The cylinder bore 21 and the guide bore 23 have substantially the same diameter, and the cylinder bore 21 opens at its one end 21*a* facing the second rocker arm 15-2, while the guide bore 23 opens at its opposite ends 23*a* and 23*b*. Slidably received within the cylinder bore 21 is a piston 20 as an engaging member which is projectable into and retractable from the guide bore 23 through the open end 21*a* of the cylinder bore 21 and the open end 23*a* of the guide bore 23. The piston 20 cooperates with the cylinder bore 21 to define an oil chamber 21*b* on the side of an end wall 15-1*b* of the first rocker arm 15-1. This oil chamber 21*b* communicates with an oil feeding passage 16*b* formed in the inlet rocker arm shaft 16 along its axis, through a hole 16*a* formed through the peripheral wall of the shaft 16, and an oil passage 15-1*a* formed through the first rocker arm 15-1. The oil feeding passage 16*b* is in turn selectively communicated with an oil pump 24 of the engine 1 or with an oil return tank 26, through a control valve 25 formed of an electromagnetic three-way valve. In FIGS. 2 and 3, reference numeral 40 denotes a compression spring interposed between the piston 20 and the first rocker arm 15-1 within the oil chamber 20 and permanently urging the piston 20 toward the second rocker arm 15-2.

A guide pin 22 as an urging member is slidably received in the guide bore 23 of the second rocker arm 15-2 and partly projected outwardly from an end wall 15-2*a* of the second rocker arm 15-2 through the outer open end 23*b* of the guide bore 23. The guide pin 22 is formed of a one-piece member and comprises an enlarged inner end portion 22*a* having substantially the same diameter as the inner end portion of the stepped guide bore 23, an intermediate portion 22*b* having a diameter smaller than that of the inner end portion 22*a* and defining an annular spring chamber 41 in cooperation with the guide bore 23, and an outer end portion 22*c* projected out of the guide bore 23. The outer end portion 22*c* of the guide pin 22 has its outer peripheral surface formed with an annular groove 27 which is permanently located outside the second rocker arm 15-2. The intermediate portion 22*b* of the guide pin 22 is formed with a diametric through hole 29 at a predetermined axial location, while the inner end portion 22*a* is disposed to abut against a shoulder 23*c* formed in an axially intermediate inner peripheral surface of the guide bore 23, for limiting an axial extreme position of the guide pin 22 when it is pulled outward. A compression spring 42 is accommodated within the spring chamber 41 and interposed between the enlarged inner end portion 22*a* of the guide pin 22 and the end wall 15-2*a* of the second rocker arm 15-2 to urge the guide pin 22 toward the first rocker arm 15-1 with an urging force larger than the counteracting force exerted by the spring 40 accommodated within the oil chamber 21*b*.

The valve disabling device constructed as above operates as follows:

When the control valve 25 is shifted to an oil-supplying position by means of a control means, not shown, during rotation of the engine, operating oil is supplied under high pressure from the oil pump 24 into the oil chamber 21*b* of the inlet valve disabling device to urgingly bias the piston 20 against the urging force of the guide pin 22 urged by the spring 42, into a position where it is partly fitted into the guide bore 23 of the second rocker arm 15-2. The piston 20 axially urges the second rocker arm 15-2 via the inner end portion 22*a* of the guide pin 22, thereby drivingly coupling the two rocker arms 15-1, 15-2 together for motion in unison with each other. Accordingly, as the cam 19 rotates, the two coupled rocker arms 15-1, 15-2 make a unitary rocking motion about the shaft 16 so that the two inlet valves 13-1, 13-2 in urging contact with the respective rocker arms 15-1, 15-2 are forced to make concurrent closing and opening motions. On this occasion, the exhaust valve disabling device operates in the same manner as the inlet valve disabling device, to cause the two exhaust valves 13'-1, 13'-2 to make concurrent closing and opening motions.

On the other hand, when the control valve 25 assumes an oil-discharging position, the pressurized operating oil in the oil chamber 21*b* of the inlet valve disabling device is discharged into the oil return tank 26. Therefore, the piston 20 is forced out of the guide bore 23 by the urging force of the guide pin 22, that is, the force of the spring 42 larger than the force of the spring 40, so that the axially urging force applied to the second rocker arm 15-2 by the piston 20 disappears to disconnect the two rocker arms 15-1, 15-2 from each other. Consequently, only the inlet valve 13-1 which corresponds to the first rocker arm 15-1 engaging the cam 19 is continually actuated to make closing and opening motions, while the inlet valve 13-2 corresponding to the second rocker arm 15-2 not engaging the cam 19 is held in a closed position by the force of the valve spring 6-2. At the same time, the exhaust valve 13'-2 corresponding to the second exhaust rocker arm 15'-2 not engaging the cam 19' is also held in a closed position. In this manner, part of the inlet and exhaust valves, i.e. the inlet valve 13-2 and the exhaust valve 13'-2, are rendered inoperative or disabled.

Next, it will be described how is carried out the tappet adjustment of the rocker arms of the valve disabling devices constructed as above, by referring to the inlet valve mechanism.

First, as shown in FIG. 2, a tool 28 for drawing the guide pin 22, such as a screw driver, is engaged in the annular groove 27 formed in the outwardly projected end portion 22*c* of the guide pin 15-2, and then swung in the couterclockwise direction as viewed in the figure, about its point of contact with the second rocker arm 15-2 to thereby displace the guide pin 22 axially outward away from the first rocker arm 15-1, until the inner end portion 22*a* is engaged by the shoulder 23*c* in the guide bore 23, whereby the diametric hole 29 is located just outside the end wall 15-2*a* of the second rocker arm 15-2. Then, a stopper pin 30 is inserted through the hole 29 to hold the guide pin 22 in the displaced position as shown in FIG. 3. Then, the stopper pin 30 has its outer peripheral surface urged against the outer surface of the end wall 15-2*a* of the second rocker arm 15-2 by the force of the spring 42. Then, the tappet adjusting screw 17-2 of the second rocker arm 15-2 is loosened to render the same rocker arm freely rockable to permit axially aligning the guide bore 23 in the second rocker arm 15-2 with the piston 20 of the first rocker arm 15-1 so that the piston 20 is partly fitted into the guide bore 23 by the urging force of the spring 40. Thus, even when no pressurized oil is supplied to the oil chamber 20*b* from the oil pump 24 during stoppage of the engine 1, the two rocker arms 15-1, 15-2 are coupled together, thereby engaging the second rocker arm 15-2 with the cam 19 through the first rocker arm 15-1. This coupling of the two rocker arms 15-1, 15-2 makes it possible to make tappet adjustment for both of the rocker arms 15-1, 15-2 to operate the two inlet valves 13-1, 13-2 with the same valving timing. That is, with the cam 19 held in an angular position corresponding to the closed positon of the inlet valves 13-1, 13-2, a thickness gauge of a thickness equal to a required tappet clearance is interposed between the cam 19 and the cam slipper 18 of the first rocker arm 15-1. The tappet adjusting screw 17-1 is then rotated until the two members 18, 19 come into contact with the thickness gauge at its opposite faces, thereby setting a position of the first rocker arm 15-1, which is assumed when the associated inlet valve 13-1 is closed. When the first and second rocker arms 15-1, 15-2 are coupled together, they assume the same angular position. Therefore, after making the above adjustment of the first rocker arm 15-1, the tappet adjustment for the second rocker arm 15-2 can be made by merely rotating the tappet adjusting screw 17-2 until the screw 17-2 abuts against the associated valve stem 13-2*a* of the inlet valve 13-2. Since the second rocker arm 15-2 does not directly engage the cam 19, the above tappet clearance is a virtual one for the second rocker arm 15-2 and defined as a clearance between the rocker arm 15-2 and a plane extending from the cam 19 in a position corresponding to a closed position of the inlet valves 13-1, 13-2.

After the tappet adjustment for the two rocker arms 15-1, 15-2, the coupled rocker arms 15-1, 15-2 cause the respective valve stems 13-1*a*, 13-2*a* to make concurrent downward motions as the cam 19 rotates, to thereby open the inlet valves 13-1, 13-2 concurrently.

In the same manner as above may be performed tappet adjustment for the two rocker arms 15'-2, 15'-2 of the exhaust valves 13'-1, 13'-2.

After completing the tappet adjustment of the rocker arms 15-1, 15-2, the stopper pin 30 is removed from the hole 29 so that the urging force of the guide pin 22, i.e. the force of the spring 42 acts upon the piston 20 to force same out of the guide bore 23 against the smaller force of the spring 40, to bring the rocker arms 15-1, 15-2 into a disconnected state which is normally assumed during stoppage of the engine. Since the urging force of the spring 40 acting upon the piston 20 is smaller than the counteracting force of the spring 42 acting upon the guide pin 22, the spring 40 does not hinder the piston 20 from being displaced by the guide pin 22 in the valve disabling direction, when the operating oil is discharged from the oil chamber 21*b*.

Figure 5:
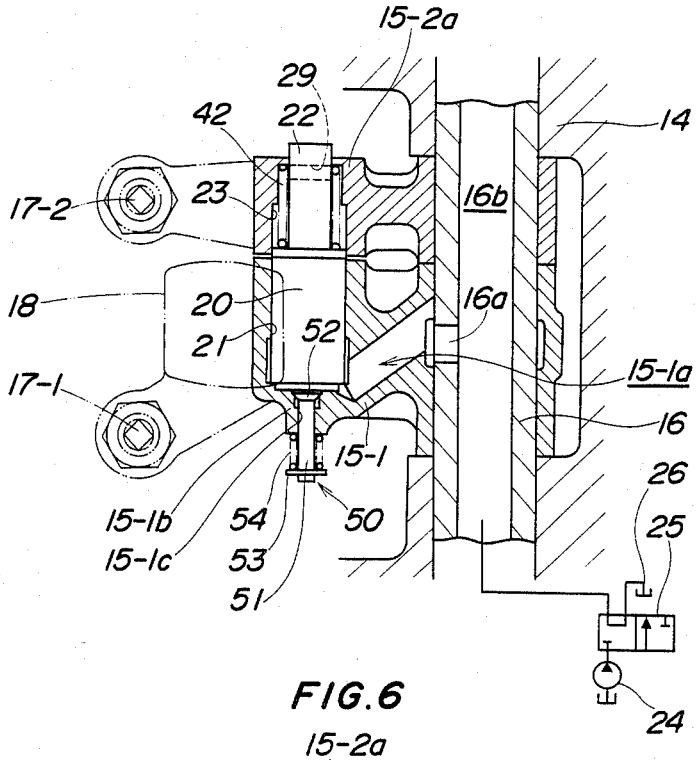
FIG. 5 is a view similar to FIG. 2, showing a valve disabling device according to a second embodiment of the invention, with the rocker arms maintained in a disconnected state.
Figure 6:
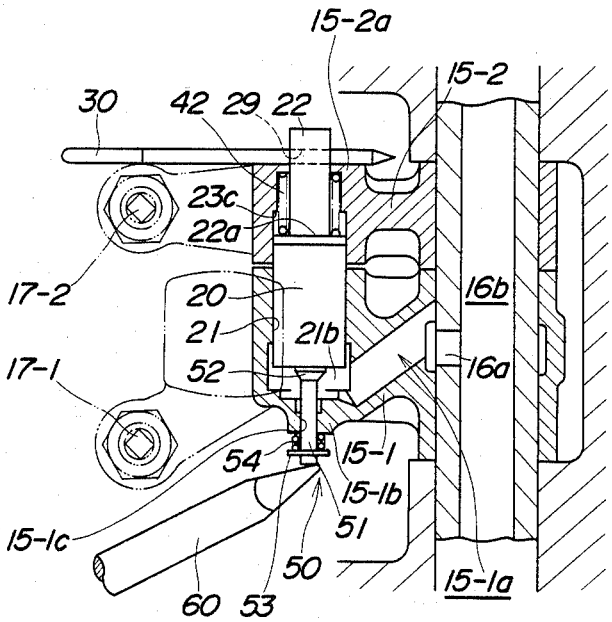
FIG. 6 is a view similar to FIG. 3, showing the rocker arms of FIG. 5 in a connected state.
Figure 7:
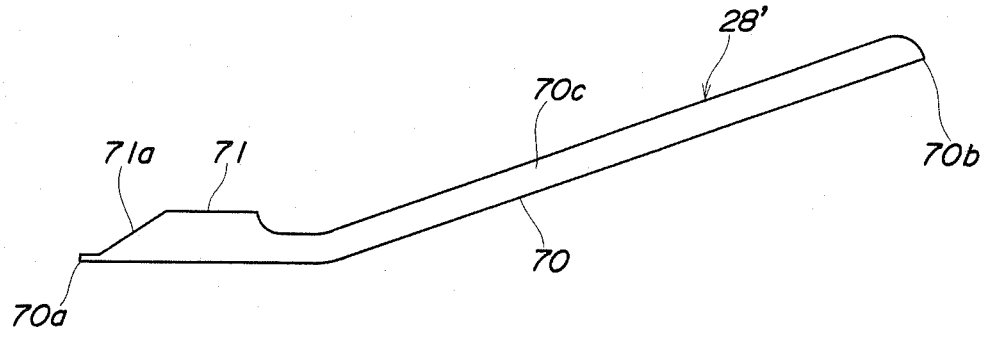
FIG. 7 is a side view of a tool for pulling and retaining a guide pin, which is used in a valve disabling device according to a third embodiment of the invention.
Figure 8:
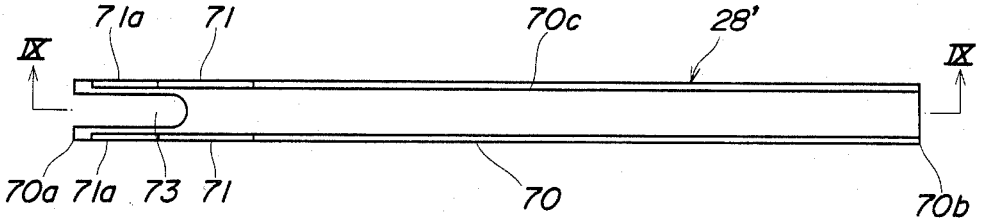
FIG. 8 is a top plan view of the tool of FIG. 7.
Figure 9:
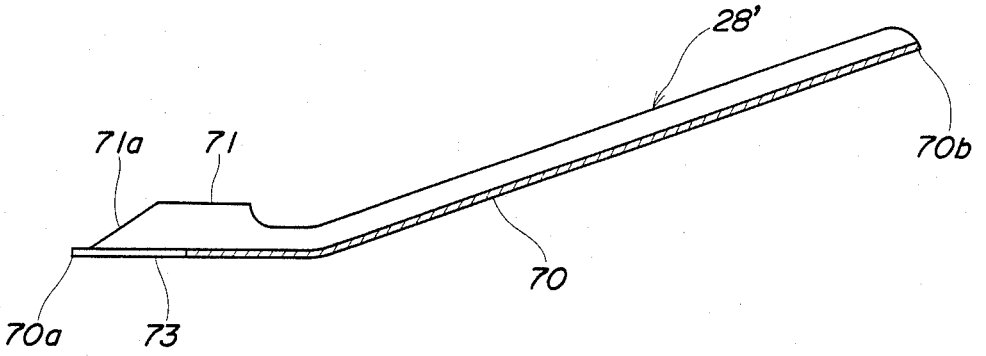
FIG. 9 is a sectional view taken along line IX—IX in FIG. 8.

FIGS. 5 and 6 show a valve disabling device according to a second embodiment of the invention, wherein means for pulling out the guide pin 22 and then retaining same in the predetermined pulled-out position is different from that of the first embodiment described above, and except for this, this embodiment is substantially identical in structure with the first embodiment. In FIGS. 5 and 6, parts and elements appearing also in the first embodiment are designated by common numerals, and detailed explanation thereof is omitted.

According to the second embodiment, the end wall 15-1*b* of the first rocker arm 15-1 is formed with a through hole 15-1*c* through which a cylindrical portion 51 of a push rod 50 extends. The cylindrical portion 51 has a conical enlarged end 52 which has a larger diameter than the inner diameter of the through hole 15-1*c*, disposed to abut against the piston 20, to serve to prevent the push rod 50 from being slipped out of the hole 15-1*c*. Further, the conical enlarged end 52 is also adapted to close an inner open end of the hole 15-1*c* in a liquidtight manner when pressurized operating oil is supplied to the cylinder bore 21, to thereby prevent leakage of the operating oil. An outer end of the cylindrical portion 51 is threaded, on which a spring seat member 53 is securedly screwed. A compression spring 54 is interposed between the spring seat member 53 and the end wall 15-1*b* of the first rocker arm 15-1 to permanently urge the push rod 50 in the axially outward direction.

According to the above arrangement, to make tappet adjustment for the rocker arms during stoppage of the engine, the push rod 50 is urgedly displaced in the axially inward direction with its outer end face by a screw driver 60 or like means, to axially force the guide pin 22 through the piston 20 into a predetermined pulled-out position. In a similar manner to the first embodiment, the tool 30 is inserted through the hole 29 of the guide pin 22 to temporarily hold the guide pin 22 in the above predetermined pulled-out position. According to this embodiment, although with the guide pin 22 held in the pulled-out position, the inner end 22*a* is not in contact with the shoulder 23*c* formed in the inner peripheral surface of the guide bore 23, as distinct from the first embodiment, the pressurized oil introduced into the oil chamber 21*b* acts upon the piston 20 to urge the end wall 15-2*a* of the second rocker arm 15-2 through the inner end portion 22*a* of the guide pin 22 and the spring 42, thereby drivingly coupling the two rocker arms 15-1, 15-2.

The valve disabling action and tappet adjustment of the second embodiment is substantially identical with those of the first embodiment, and therefore explanation thereof is omitted.

Next, a third embodiment of the invention will be described with reference to FIGS. 7 through 12. The third embodiment is substantially identical in basic structure with the first embodiment, but different therefrom in that, according to the third embodiment, a tool 28' is employed in lieu of the tool 28 and the stopper pin 30 in the first embodiment, and the guide pin 22 does not have a diametric hole like the hole 29 formed therein. As shown in detail in FIGS. 7 through 9, the tool 28' for pulling and retaining the guide pin 22 has a bar-like main body 70 formed of a metal plate bent into a U-shaped cross section, and a U-shaped elongate cut-out engaging portion 73 formed in an end 70*a* of the main body 70, with opposite lateral wall projections 71 extending from lateral walls 70*c* of the main body 70. A major portion of the main body 70 extending from the engaging portion 73 to the other end 70*b* is bent in the same direction of projection of the projection walls 71 through an angle of about 15 degrees with respect to the bottom wall of the tip 70*a*. Each of the projection walls 71 has a tapered end edge 71*a*.

Figure 10:
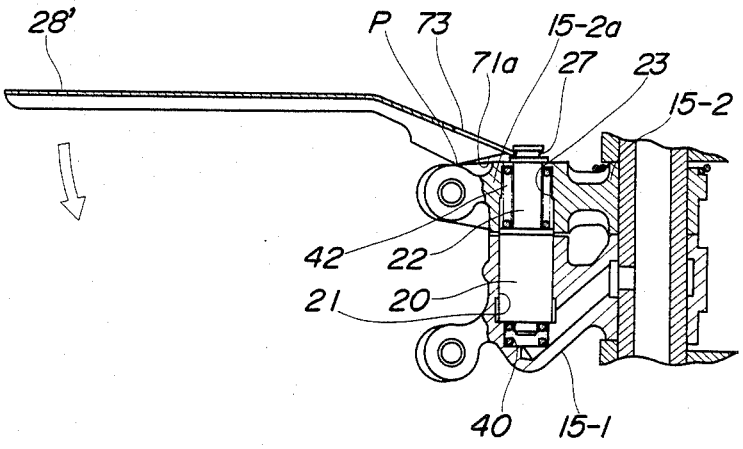
FIG. 10 is a fragmentary sectional view of the valve disabling device according to the third embodiment of the invention, with the tool of FIG. 7 engaged with the guide pin.
Figure 11:
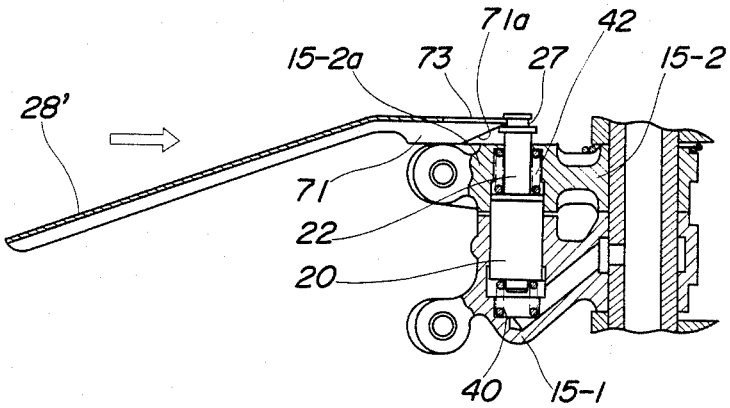
FIG. 11 is a view similar to FIG. 10, showing the guide pin pulled out of its bore by means of the tool.
Figure 12:
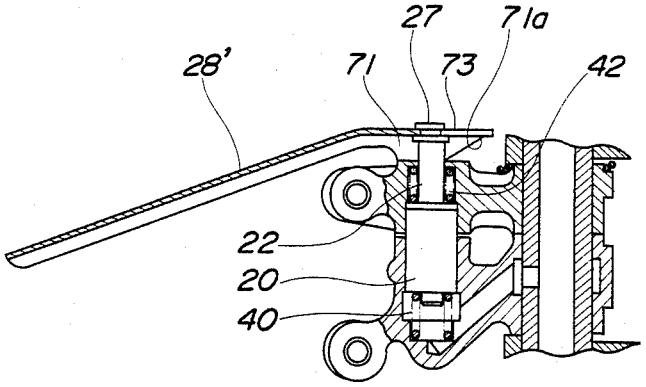
FIG. 12 is a view similar to FIG. 10, showing the guide pin retained in the pulled-out position by means of the tool.

The tool 28' constructed as above is operated in the following manner: As shown in FIGS. 10 through 12, first, with the guide bore 23 of the second rocker arm 15-2 aligned with the cylinder bore 21 of the first rocker arm 15-1, the tip of the engaging portion 73 of the tool 28' is engaged in the groove 27 of the guide pin 22, and is held with the end edges 71*a* of the projection walls 71 abutting against the end wall 15-2*a* of the second rocker arm 15-2 as in the illustrated position of FIG. 10.

With the tool 28' kept in the above position, the tool 28' is swung in the counterclockwise direction indicated by the arrow in FIG. 10 about a point of contact P of the tool 28' with the second rocker arm 15-2 until the projection walls 71 abut against the end wall 15-2*a* of the second rocker arm 15-2, as shown in FIG. 11. By thus moving the tool 28' in the counterclockwise direction in FIG. 10, the guide pin 22 is partly pulled out of the second rocker arm 15-2 in the direction away from the first rocker arm 15-1, against the urging force of the spring 42. The piston 21 is then correspondingly displaced toward the second rocker arm 15-2 by the urging force of the spring 40 into the guide bore 23 of the second rocker arm 15-2, thus drivingly coupling the two rocker arms 15-1, 15-2 through the piston 20.

Thereafter, the tool 18' is pushed toward the valve disabling device nearly at right angles to the axis of the guide pin 22, as indicated by the arrow in FIG. 11, until the groove 27 of the guide pin 22 engages the engaging portion 73 of the tool 28' at its innermost portion, whereby the projection walls 71 are in contact with an outer surface of the end wall of the second rocker arm 15-2 on an axial extension of the guide bore 23, as shown in FIG. 12. In this position, the piston 20 is axially biased into contact with the guide pin by urging force of the spring 40, whereby the two rocker arms 15-1, 15-2 are drivingly coupled together through the piston 20, the guide pin 22 and the spring 42. With the valve disabling device held in this position, tappet adjustment is made in the same manner as in the first embodiment, and after completing the adjustment, the tool 28' is removed from the guide pin 22 to disconnect the rocker arms 15-1, 15-2 from each other.

It may be so arranged that the same tool 28' can be used for adjusting the exhaust valve rocker arms, as well.

Although, in the foregoing embodiments, the cams 19, 19' are disposed for engagement with the respective first rocker arms 15-1, 15'-1, which are formed therein with the oil chambers 21*b*, the cams 19, 19' may alternatively be disposed for engagement with the respective second rocker arms 15-2, 15'-2.

Further, as alternative means for holding the guide pin 22 in the predetermined pulled-out position, the outer end of the guide pin 22 may be threaded and a nut may be threadedly fitted on the same outer end to retain the guide pin 22 in the predetermined position.

What is claimed is:

1. In a valve disabling device for use in a valve actuating mechanism of an internal combustion engine, said valve actuating mechanism having cam means, inlet valve means and exhaust valve means, at least one of which comprises a pair of valves, and first and second rocker arm means juxtaposed with each other and engaging said at least one of said inlet valve means and said exhaust valve means, one of said first and second rocker arm means engaging said cam means, said valve disabling device including an engaging member slidably disposed within a first axial bore formed in said first rocker arm means, said engaging member being projectable into and retractable from a second axial bore formed in said second rocker arm means in alignment with said first axial bore, an urging member slidably disposed within said second axial bore, urging means urging said urging member against said engaging member, and pressure applying means for hydraulically forcing said engaging member into said second axial bore against the urging force of said urging means, whereby said first and second rocker arm means are drivingly coupled together to cause said at least one of said inlet valve means and said exhaust valve means to make valving motions in unison with each other, while when said pressure applying means is inoperative, said urging means causes said engaging member to recede from said second axial bore through said urging member to thereby disconnect said first and second rocker arm means from each other; the improvement comprising: biasing means for biasing said engaging member into said second axial bore to drivingly couple said first and second rocker arm means together irrespective of whether said pressure applying means is operative or inoperative, said urging member being adapted to assume a predetermined position where a portion thereof is projected out of said second axial bore for access from outside, when said engaging member is biased by said biasing means; and retaining means for retaining said urging member in said predetermined position.

2. A valve disabling device as claimed in claim 1, wherein said biasing means comprises spring means for urging said engaging member into said second axial bore with an urging force smaller than the urging force of said urging means.

3. A valve disabling device as claimed in claim 1, wherein said first rocker arm means includes an end wall remote from said second rocker arm means, said end wall having a through hole formed therein and defining part of said first axial bore, said biasing means comprising a push rod slidably disposed through said through hole, said push rod being axially displaceable at will for abutting against said engaging member to bias said engaging member into said second axial bore as said push rod is displaced toward said second rocker arm means.

4. A valve disabling device as claimed in claim 1 or claim 2, wherein said urging member has an outer end portion disposed out of said second axial bore for access from outside said second rocker arm means, said outer end portion having a peripheral surface thereof formed with a groove for engagement with said retaining means.

5. A valve disabling device as claimed in any of claims 1 to 3, wherein said second rocker arm means includes an end wall defining part of said second axial bore and having an outer surface, said retaining means comprising a through hole extending in said urging member diametrically thereof at a predetermined axial location outside said second rocker arm means, and a retaining member adapted to be inserted through said through hole, said retaining member abutting against said outer surface of said end wall of said second rocker arm means when inserted through said through hole, to thereby retain said urging member in said predetermined position.

6. A valve disabling device as claimed in claim 3, wherein said push rod of said biasing means has a conical enlarged portion disposed within said first axial bore, said conical enlarged portion having a diameter larger than the inner diameter of said through hole formed in said end wall of said first rocker arm means, for closing said through hole in a liquidtight manner.

7. A valve disabling device as claimed in claim 6, including second urging means urging said push rod in a direction away from said engaging member, said second urging means being disposed to bias said push rod into a position where said conical enlarged portion thereof closes said through hole of said end wall of said first rocker arm means in a liquidtight manner.

8. A valve disabling device as claimed in any of claims 1 to 3, wherein said second axial bore has an inner peripheral surface thereof formed with a shoulder, said urging member having one end facing said engaging member, said shoulder of said second axial bore being disposed at such a predetermined axial location that said one end of said urging member abuts against said shoulder when said urging member assumes said predetermined position.

9. A valve disabling device as claimed in claim 1, wherein said second rocker arm means includes an end wall remote from said first rocker arm means and having an outer surface, said second axial bore extending through said end wall and opening in said outer surface, said urging member being disposed to project outside said second rocker arm means through said second axial bore.

10. A valve disabling device as claimed in claim 1, wherein said engaging member cooperates with said first axial bore to define an oil chamber disposed such that operating oil under high pressure therein acts upon said engaging member, said pressure applying means comprising said oil chamber, and selecting means selectively operable to supply said oil chamber with said operating oil and to discharge the operating oil from said oil chamber.

11. A valve disabling device as claimed in claim 1, wherein each of said inlet valve means and said exhaust valve means has a valve stem, said first and second rocker arm means each having a tappet adjusting screw threadedly fitted therein for axial displacement to abut against a corresponding one of said valve stems.

* * * * *